US007597429B2

(12) United States Patent
Miura et al.

(10) Patent No.: US 7,597,429 B2
(45) Date of Patent: Oct. 6, 2009

(54) THERMAL PRINTER AND CONTROL METHOD THEREFOR

(75) Inventors: Shinya Miura, Yamanashi (JP); Shinichi Miyashita, Yamanashi (JP)

(73) Assignee: Citizen Holdings Co., Ltd., Tokyo (JP)

( * ) Notice: Subject to any disclaimer, the term of this patent is extended or adjusted under 35 U.S.C. 154(b) by 428 days.

(21) Appl. No.: 11/489,687

(22) Filed: Jul. 20, 2006

(65) Prior Publication Data

US 2007/0024692 A1 Feb. 1, 2007

(30) Foreign Application Priority Data

Jul. 28, 2005 (JP) ..... 2005/219712

(51) Int. Cl.
*B41J 2/045* (2006.01)

(52) U.S. Cl. ..... 347/71

(58) Field of Classification Search ..... 347/189, 347/194, 193, 191, 180, 171
See application file for complete search history.

(56) References Cited

U.S. PATENT DOCUMENTS

2006/0158506 A1* 7/2006 Naito et al. ..... 347/180

FOREIGN PATENT DOCUMENTS

| | | |
|---|---|---|
| JP | 5-4371 | 1/1993 |
| JP | 8-1985 | 1/1996 |
| JP | 11-179991 | 7/1999 |
| JP | 2001-191577 | 7/2001 |

* cited by examiner

*Primary Examiner*—K. Feggins
(74) *Attorney, Agent, or Firm*—Smith, Gambrell & Russell, LLP

(57) ABSTRACT

In a thermal printer provided with a thermal head printing on a paper sheet and a paper feed motor feeding the paper sheet, the operation of the thermal head and the paper feed motor is controlled on the basis of detected temperature data of the thermal head and the paper feed motor detected by a single temperature detecting device.

13 Claims, 13 Drawing Sheets

THERMAL PRINTER AND CONTROL METHOD THEREFOR

BACKGROUND OF THE INVENTION

1. Field of the Invention

The present invention relates to a thermal printer and a control method therefor.

2. Description of the Related Art

A conventional thermal printer of this type is provided with a thermal head unit and a paper feed motor as heat generating bodies. Therefore, in order to prevent these heat generating bodies from being heated and burnt out, the conventional thermal printer and a control method therefor are constituted such that a temperature detecting device is attached to each of the thermal head unit and the paper feed motor, and that outputs from the temperature detecting devices are monitored by a control circuit, and power supply to the thermal head unit and the paper feed motor is inhibited so as to prevent each temperature of the thermal head unit and the paper feed motor from exceeding a prescribed allowable value.

In the following, several prior art examples will be described with reference to the accompanying drawings.

First, the whole structure of a thermal printer disclosed in Japanese Patent Application Laid-Open No. 5-4371 is explained as a first prior art example by using a block diagram shown in FIG. 10.

When the temperature of a thermal head is changed, information indicating the temperature change is converted into a digital signal in a temperature control circuit. Further, environmental temperature information is added to the digital signal in the temperature control circuit, and the resultant signal is sent to an oscillation circuit in a motor control circuit. A signal sent from the oscillation circuit is a reference signal for the rotation of the motor, and hence, the rotation speed of the motor is changed in association with the reference signal. That is, the speed of the motor is changed with the temperature change in the thermal head. Further, when the environmental temperature in the device is changed, the rotation speed of the motor is also changed similarly to the case where the temperature in the thermal head is changed. Further, information from a system controller is also added in the temperature control circuit. As a result, the necessary speed change of the motor can be performed from the system controller, in addition to the amount of speed change of the motor based on the temperature change in the thermal head.

Next, a system structure of a label printer disclosed in Japanese Patent Application Laid-Open No. 8-1985 is explained as a second prior art example by using a block diagram shown in FIG. 11.

The temperature of a power supply section which controls power supplied to a print head is detected by a temperature sensor. An interval time corresponding to the temperature detected by the temperature sensor is read from storing means, and a label is issued at the interval time. Thus, when the temperature of power supply section is raised, the interval time for issuing the label is increased, thereby preventing the thermal destruction of the power supply section.

Next, a line thermal printer disclosed in Japanese Patent Application Laid-Open No. 11-179991 is explained as a third prior art example by using a block diagram shown in FIG. 12.

When the temperature of a paper feed motor is raised by continuous printing, a step-out speed region is expanded by a decrease in the motor feed torque. The expansion of the step-out speed region is at a maximum when the temperature of the paper feed motor reaches a maximum temperature value. In the case where the step-out speed region is not controlled in response to the temperature rise of the paper feed motor, the step-out speed region is set to one at the maximum temperature value of the paper feed motor. As a result, when the temperature of the paper feed motor is low, the step-out speed region is set more widely than needed. Accordingly, the motor speed in deceleration is subjected to deceleration correction, so that the printing speed is lowered. On the other hand, by switching the step-out speed regions with the temperature of the paper feed motor, it is possible to prevent the deceleration correction from being performed more than needed and suppress the printing speed reduction.

Next, a thermal printer disclosed in Japanese Patent Application Laid-Open No. 2001-191577 is explained as a fourth prior art example by using a block diagram shown in FIG. 13.

When the temperature of a thermal head is raised, an error may occur in a CPU so that the CPU fails to function normally. In such a case, the temperature of the thermal head is further raised to cause a voltage V to be further decreased. Finally, when the voltage V drops below a reference voltage, the output of an operational amplifier CMP reaches the L level (LHERR=L). This L level signal is a head error signal. As a result, the output of a two-input AND gate G reaches the L level so that TR1 and TR2 are turned off. This interrupts supply of head drive current from a head drive power supply Vp to the thermal head 4. In this way, even when the CPU fails to normally function, it is possible to recover a safe state from the heated state of the thermal head.

Next, a state of a paper feed motor and a thermal head in a thermal printer based on the knowledge of the present inventors is explained as a fifth prior art example by using FIG. 14.

When a print command is received at a control circuit (not shown), a paper feed motor 105 is driven by control of the control circuit, and a paper sheet (not shown) is conveyed, and a thermal head 103*b* is driven by control of the control circuit for printing on the paper sheet.

The thermal head 103*b* and a heat dissipating member 103*a* constitute a thermal head unit 103. The heat generated by the thermal head 103*b* is dissipated to the outside air through the heat dissipating member 103*a* to some extent. However, when such printing operation is continued, the temperature of the paper feed motor 105 and the thermal head 103*b* is successively raised. In the case where the environment temperature is high, the temperature may exceed an allowable temperature at a certain point of time, thereby causing the paper feed motor 105 and thermal head 103*b* to be burnt out. On the other hand, a heat radiating member such as the heat-dissipating member 103*a* of the thermal head unit 103 is not provided to deal with the heat generated by the paper feed motor 105. This makes the temperature rise in the paper feed motor 105 severer than the temperature rise in the thermal head 103*b*.

In order to detect temperatures of the thermal head, the power supply section or the paper feed motor, and to prevent the respective detected temperatures from exceeding an allowable value, in the first prior art example (in FIG. 10), the rotation speed of the motor is controlled on the basis of the temperature of the thermal head and the environmental temperature information, thereby suppressing the temperature of the thermal head from being further raised. In the second prior art example (in FIG. 11), when the temperature of the power supply section supplying power to the thermal head is raised, the interval time at which the label is issued is increased, thereby preventing the power supply section from being thermally destructed. In the third prior art example (in FIG. 12), the step-out speed region is switched in response to the temperature of the paper feed motor, thereby preventing the deceleration correction from being performed more than needed and suppressing a decrease in the printing speed. In the fourth prior art example (in FIG. 13), in the case where the temperature of the thermal head is raised so as to be ready to exceed an allowable value, when an error occurs in the CPU, TR1 and TR2 are made to interrupt the supply of head drive current to the thermal head 4.

In the fifth prior art example (in FIG. 14), in order to prevent the paper feed motor 105 and the thermal head 103 from being burnt out, a motor temperature detecting device 111 is attached to the paper feed motor 105, and a head temperature detecting device 110 is attached to the thermal head 103, so as to prevent the respective temperatures of the paper feed motor 105 and the thermal head 103 from exceeding an allowable temperature. Then, when the temperature of the paper feed motor 105 is ready to exceed the allowable temperature, an output is produced by the motor temperature detecting device 111 toward the control circuit. On the other hand, the control circuit which receives the output inhibits the power supply to the paper feed motor 105. Similarly, when the temperature of the thermal head 103 is ready to exceed the allowable temperature, an output is produced by the head temperature detecting device 110 toward the control circuit, and the control circuit which receives the output inhibits the power supply to the thermal head 103.

As described above, a conventional temperature control device for preventing heat generating bodies, such as a thermal head, a power supply section, or a paper feed motor from being heated and burnt out, is constituted such that a temperature detecting device is attached to each of the heat generating bodies, and that a control circuit monitors the output from the temperature detecting device and thereby inhibits the power supply so as to prevent the respective temperatures of the heat generating bodies from exceeding an allowable value. Therefore, such structure is expensive because a temperature detecting device is attached to each of the heat generating bodies.

SUMMARY OF THE INVENTION

An object of the present invention is to simplify a structure for detecting temperature and provide a thermal printer capable of suppressing heat generation in a thermal head and a paper feed motor.

A thermal printer according to a first aspect of the present invention comprises a thermal head printing on a paper sheet and a paper feed motor for feeding the paper sheet, wherein operation of the thermal head and the paper feed motor is controlled on the basis of the temperature detection data of the thermal head and the paper feed motor detected by a single temperature detecting device.

A thermal printer according to a second aspect of the present invention comprises a thermal head unit including a thermal head for printing on a paper sheet, a paper feed motor for feeding the paper sheet, a heat conducting member provided between the thermal head unit and the paper feed motor, and a single temperature detecting device for detecting temperature of the thermal head unit and the paper feed motor.

A thermal printer of a third aspect of the present invention comprises a thermal head unit including a thermal head for printing on a paper sheet, a paper feed motor for feeding the paper sheet, a heat conducting member provided between the thermal head unit and the paper feed motor, a single temperature detecting device for detecting temperature of the thermal head unit and the paper feed motor, and a control section for controlling operation of the thermal head unit and the paper feed motor, and in that the control section controls operation of the thermal head unit and the paper feed motor on the basis of detected temperature data of the thermal head unit and the paper feed motor detected by the single temperature detecting device.

The thermal printer according to the second and third aspects can be formed into the following embodiments.

The thermal head unit may include a heat-dissipating member besides the thermal head.

The temperature detecting device may be provided in the thermal head unit.

The heat conducting member may be deformed in response to the change in the distance between the thermal head and the paper feed motor so as to be always in contact with the paper feed motor, thereby effecting heat conduction to the thermal head. Further, as a material for the heat conducting member, it is possible to use silicone rubber, a plate made of an aluminum alloy, or a plate made of a copper alloy.

The thermal printer according to the third aspect can be formed into the following embodiments.

In order to prevent the thermal head and the paper feed motor from being heated and burnt out, a first set temperature for suppressing the respective temperatures of the thermal head and the paper feed motor to an allowable temperature or lower, and a second set temperature for restarting the drive of the thermal head and the paper feed motor may be set.

A third set temperature between the first set temperature and the second set temperature may also be set, so that when it is judged on the basis of the detected temperature data that the temperature is raised to reach the third set temperature, the rotation speed of the paper feed motor is set to be lower than the rotation speed before the judgment is made.

A first aspect of a thermal printer control method according to the present invention, is characterized in that a thermal printer provided with a thermal head for printing on a paper sheet, a paper feed motor for feeding the paper sheet, a single temperature detecting device for detecting temperature of the thermal head and the paper feed motor, and a control section for controlling operation of the thermal head and the paper feed motor is used, and in that the control section controls operation of the thermal head and the paper feed motor on the basis of detected temperature data of the thermal head and the paper feed motor detected by the single temperature detecting device.

A second aspect of a thermal printer control method according to the present invention is characterized in that a thermal printer provided with a thermal head unit including a thermal head for printing on a paper sheet, a paper feed motor for feeding the paper sheet, a single temperature detecting device for detecting temperature of the paper feed motor and the thermal head unit, a control section for controlling operation of the thermal head and the paper feed motor is used, and in that the control section controls operation of the thermal head unit and the paper feed motor on the basis of the detected temperature data detected by the single temperature detecting device.

The thermal printer control method according to the first and second aspects can be formed into the following embodiments.

The control section may perform control in such a manner that when it is judged that the detected temperature data reaches a first set temperature, the control section stops the drive of the thermal head unit and the paper feed motor so as to make the printing operation stopped, and that when it is judged that the detected temperature data reaches a second set temperature lower than the first set temperature, the control section drives the thermal head unit and the paper feed motor so as to restart the printing operation.

A third set temperature may be set between the first set temperature and the second set temperature, and the control section may perform control in a manner that when it is judged that the detected temperature data is raised to reach the third set temperature, the control section makes the rotation speed of the paper feed motor lower than the rotation speed before the judgment is made.

According to the present invention constituted as described above, it is possible to prevent burnout caused by a temperature rise of a thermal head and a paper feed motor by a single temperature detecting device. As a result, it is possible to prevent the burnout caused by the temperature rise of the thermal head and the paper feed motor, with reduced manufacturing cost.

BRIEF DESCRIPTION OF THE DRAWINGS

The above and other objects and features of the present invention will be more apparent from the following description of the preferred embodiments with reference to the accompanying drawings, wherein.

DETAILED DESCRIPTION OF THE PREFERRED EMBODIMENTS

A schematic configuration of a first embodiment of a thermal printer according to the present invention is explained by using FIGS. 1 to 4.

Figure 1:
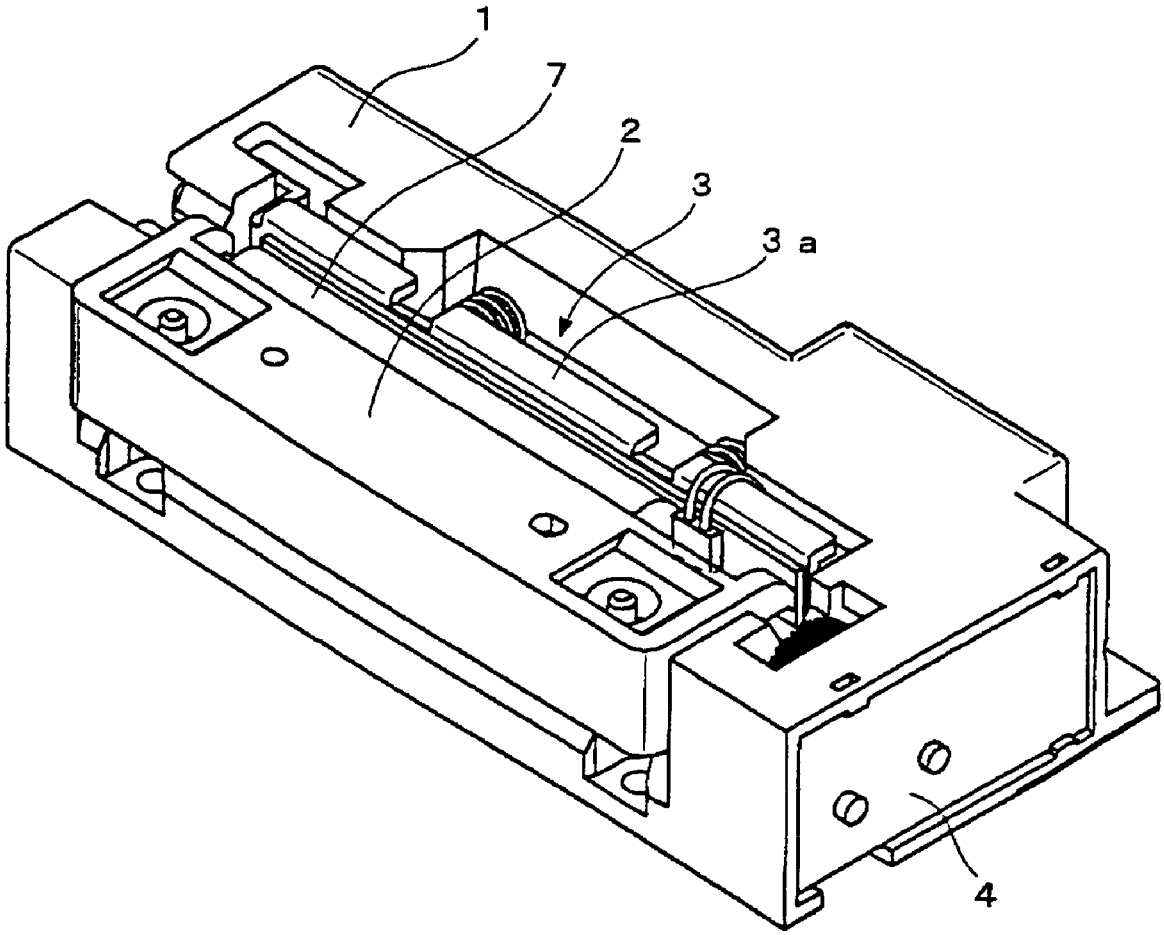
FIG. 1 is a perspective view of a first embodiment of a thermal printer according to the present invention.

As shown in FIG. 1, a paper feed roller holder 2 for supporting a paper feed roller 7 is detachably attached to a frame body 1. Further, a thermal head unit 3, which is constituted by a thermal head 3*b* arranged opposite the paper feed roller 7 and a heat-dissipating member 3*a* for making heat generated by the thermal head 3*b* dissipated to the atmosphere, is attached to the frame body 1.

Figure 2:
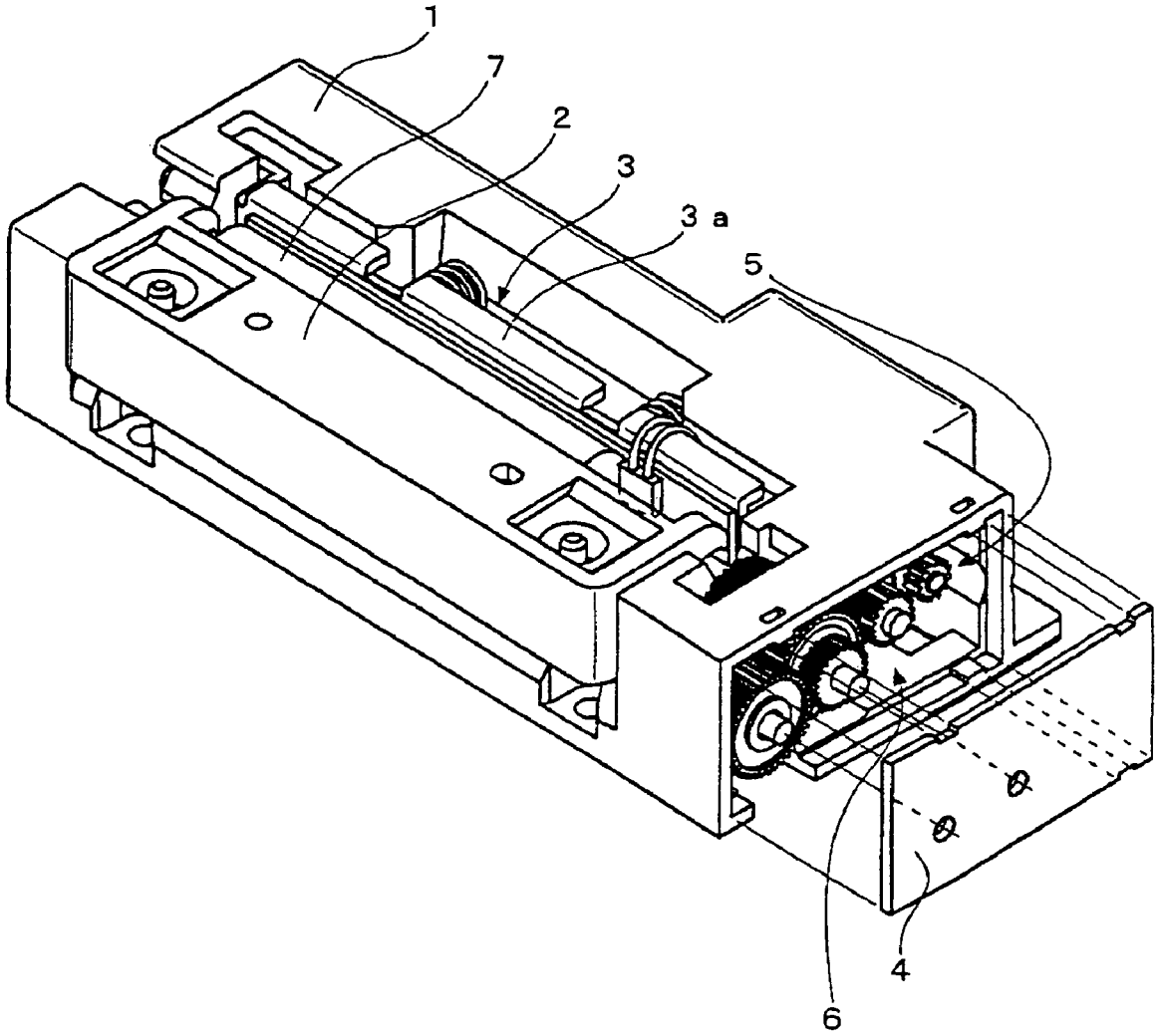
FIG. 2 is an illustration showing a state where a gear cover is removed from a frame body of the thermal printer shown in FIG. 1.

As shown in FIG. 2, a gear train 6 for transmitting rotational drive force of a paper feed motor 5 to the paper feed roller 7 is also attached to the frame body 1, and the gear train 6 is covered with a gear cover 4.

Figure 3:
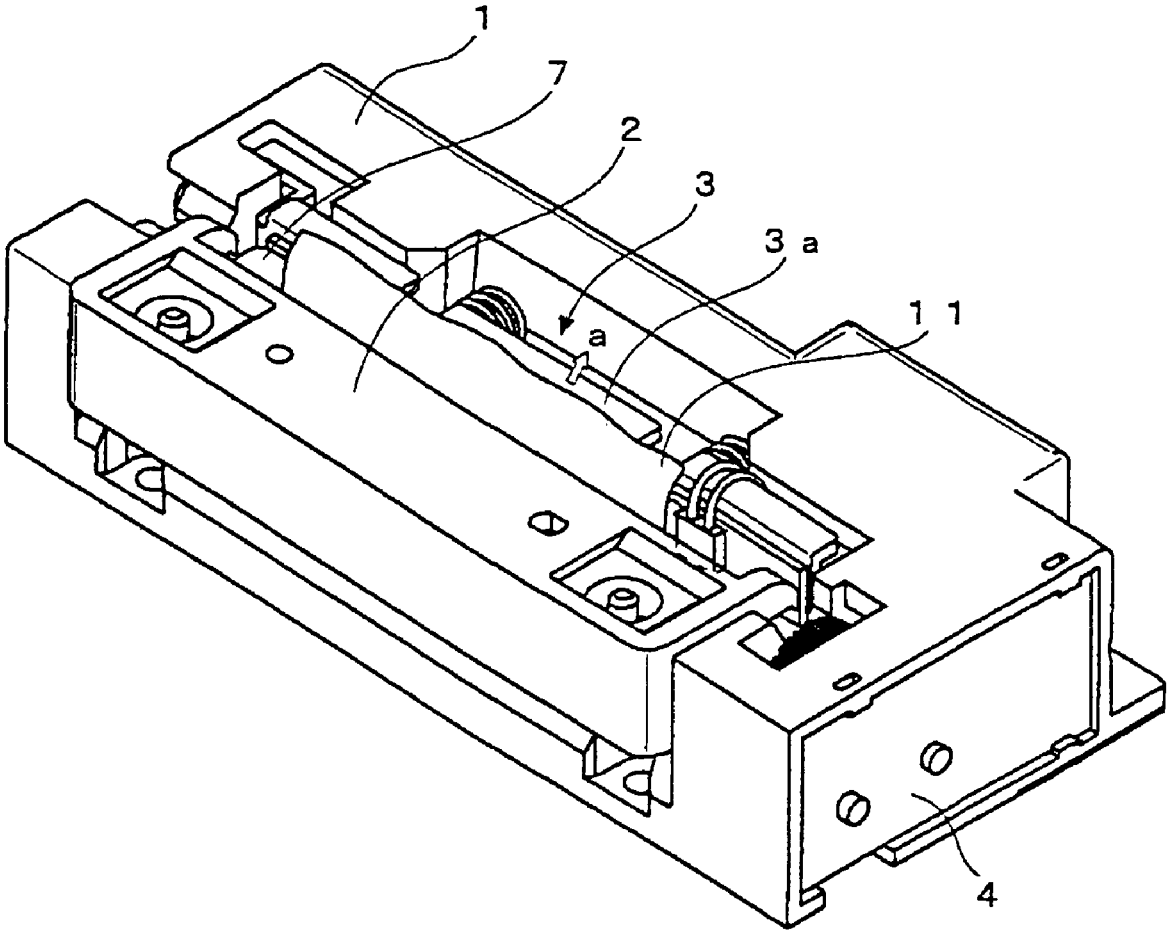
FIG. 3 is an illustration showing a state where the thermal printer shown in FIG. 1 is loaded with a paper sheet.

As shown in FIG. 3, the above described thermal printer is loaded with a paper sheet 11, and thereby the paper sheet 11 is printed.

Figure 4:
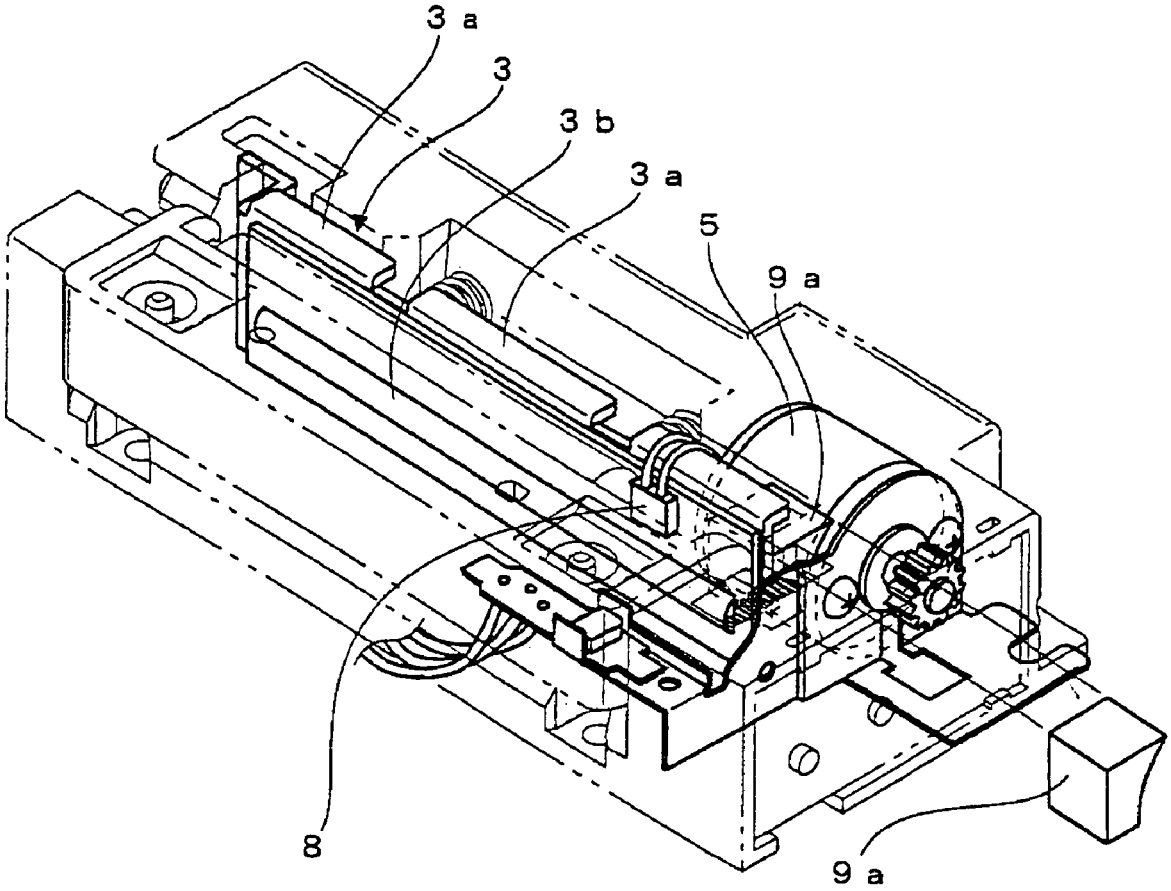
FIG. 4 is an illustration showing a state of a paper feed motor and a thermal head unit which are incorporated in the thermal printer shown in FIG. 1.

A structure of a temperature control device in the first embodiment of the thermal printer according to the present invention is explained by using FIG. 4.

A first heat conducting member 9*a* formed of a material having high thermal conductivity and elasticity is secured between the paper feed motor 5 and the heat-dissipating member 3*a* of the thermal head unit 3. The first heat conducting member 9*a* transfers the heat generated by the paper feed motor 5 to the thermal head unit 3.

In the present embodiment, the thermal head unit 3 is constituted by the heat-dissipating member 3*a* and the thermal head 3*b*, and the first heat conducting member 9*a* is secured between the paper feed motor 5 and the thermal head 3*b*. However, the first heat conducting member 9*a* may also be secured between the paper feed motor 5 and the heat-dissipating member 3*a*.

The thermal head unit 3 is pressed against the paper feed roller 7 by an elastic member in order to make the paper sheet 11 with various thickness press contacted to the thermal head 3*b*. Accordingly, the thermal head unit 3 is moved in the front and back directions depending upon the thickness of the paper sheet 11, thereby causing the interval between the paper feed motor 5 and the thermal head unit 3 to be changed. Therefore, the first heat conducting member 9*a* is required to have elasticity because it needs to follow the change in this interval.

Further, the thermal head 3*b* constituting the thermal head unit 3 is provided with a temperature detecting device 8 which detects the temperature of the thermal head 3*b* raised by the heat generated by the thermal head 3*b* and the heat generated by the paper feed motor 5, and which transmits the detected temperature to a control circuit (not shown).

As an example of the first heat conducting member 9*a* formed of a material having high thermal conductivity and elasticity, a member made of low hardness high thermal conductivity silicone rubber is adopted. The low hardness high thermal conductivity silicone rubber which has high thermal conductivity and flame retardancy, and which is soft and tacky and hence has good adhesiveness, is suitable as a material of the heat conducting member. Incidentally, in the low hardness high thermal conductivity silicone rubber adopted in the present embodiment, the thermal conductivity is set to 2.5 W/m.k, and the hardness is set to 30 Asker C.

The temperature detecting device 8 in the present embodiment is a contact type temperature detecting element using a thermocouple, and is attached to the thermal head 3*b* constituting the thermal head unit 3 with a silicon adhesive. However, the temperature detecting device 8 may also be attached to the heat-dissipating member constituting the thermal head unit 3, or to the paper feed motor 5. Note that the method for attaching the temperature detecting device is not limited to adhesion, but a method in which the temperature detecting device is fixed by using a fastening member such as a screw may also be used. Further, the temperature detecting device is not limited to a contact type thermistor thermocouple, but may be a noncontact type thermo-pile.

Figure 5:
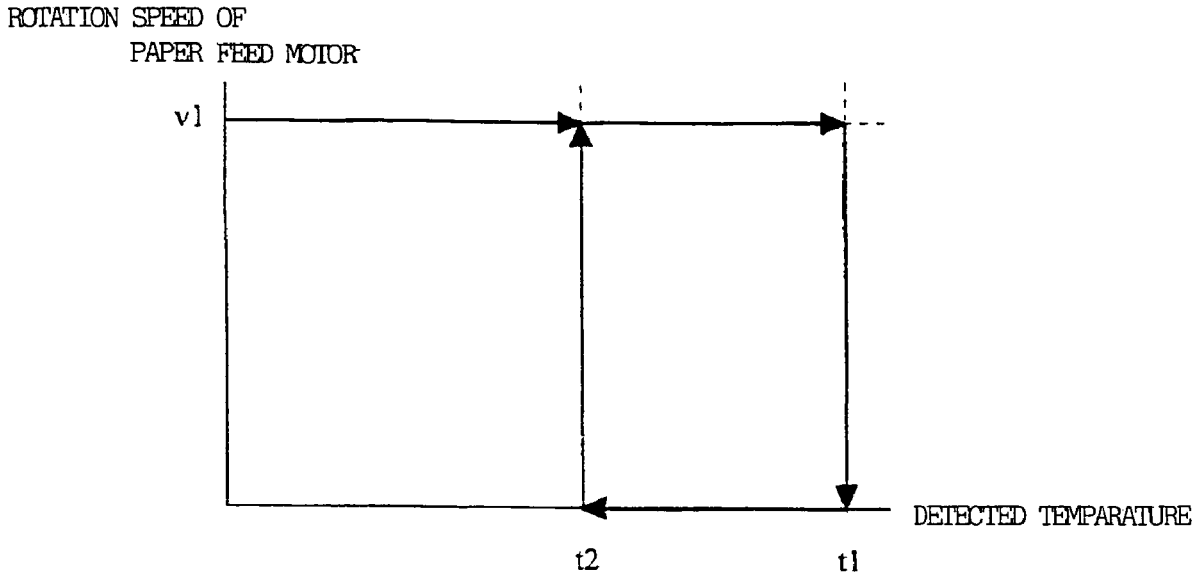
FIG. 5 is a graph showing a relationship between the detected temperature and the rotation speed of a paper feed motor based on a first thermal printer control method according to the present invention.

A relationship between the detected temperature and the drive of the thermal head 3*b* and the drive speed of the paper feed motor based on the first control method is explained by using FIG. 5.

When the temperature detecting device 8 detects that the temperature of one of the thermal head 3*b* and the paper feed motor 5 reaches a first set temperature t1 which is set beforehand so as to prevent the temperature of one of the thermal head 3*b* and the paper feed motor 5 from exceeding an allowable temperature, a control circuit (not shown) stops the drive of the thermal head 3*b* and the paper feed motor 5 rotating at a rotation speed v1. When the temperature is lowered to reach a second set temperature t2 by heat dissipation in the state where the thermal head 3*b* and the paper feed motor 5 are stopped, the control circuit starts the drive of the thermal head 3*b* and the paper feed motor 5. Incidentally, the allowable temperature value of the thermal head 3*b* adopted in the first control method is set to 65° C., the allowable temperature value of the paper feed motor 5 is set to 115° C. In relation to these values, the first set temperature t1 is set to 65° C., and the second set temperature t2 is set to 60° C.

Figure 6:
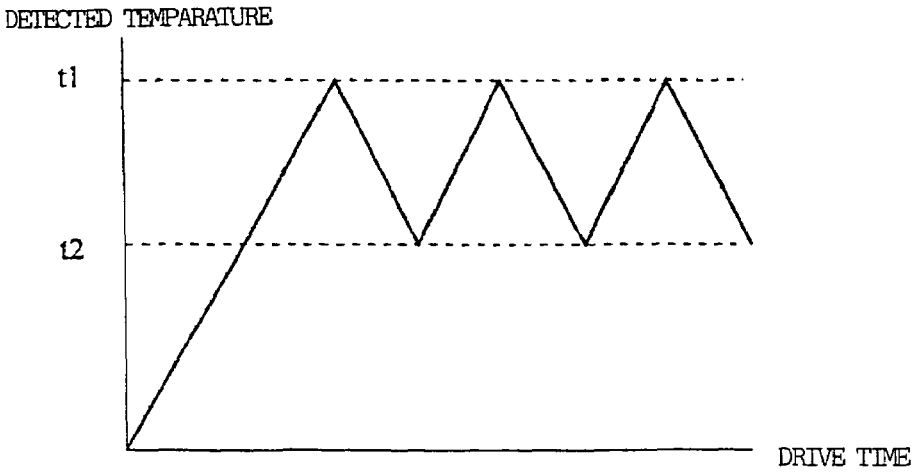
FIG. 6 is a graph showing a relationship between the thermal printer drive time and the detected temperature based on the first control method.

A relationship between the drive time and the detected temperature based on the first control method is explained by using FIG. 6.

As described above, when the temperature detected by the temperature detecting device 8 reaches the first set temperature t1, the control circuit (not shown) stops the drive of the thermal head 3*b* and the paper feed motor 5. When the temperature detected by the temperature detecting device 8 is lowered by the stopping of the drive of the thermal head 3*b* and the paper feed motor 5 to reach the second set temperature t2, the control circuit starts the drive of the thermal head 3*b* and the paper feed motor 5. When the temperature detected by the temperature detecting device 8 is raised by the starting of the drive of the thermal head 3*b* and the paper feed motor 5 to reach the first set temperature t1, the control circuit stops the drive of the thermal head 3*b* and the paper feed motor 5. Thereby, the temperature of the thermal head 3*b* and the paper feed motor 5 is lowered by heat dissipation.

In this way, on the basis of the detected temperature data of the thermal head 3*b* and the paper feed motor 5 detected by the single temperature detecting device 8, the operation of the thermal head 3*b* and the paper feed motor 5 is controlled. As a result, it is possible to realize, with a small number of components and simple structure, a state where the temperature detected by the temperature detecting device 8 is prevented from exceeding the first set temperature t1, and where the temperature of the thermal head 3*b* or the paper feed motor 5 is prevented from exceeding the allowable temperature. Therefore, it is possible to obtain a thermal printer which is less expensive and which is capable of preventing the thermal head 3*b* and the paper feed motor 5 from being burnt out.

Figure 7:
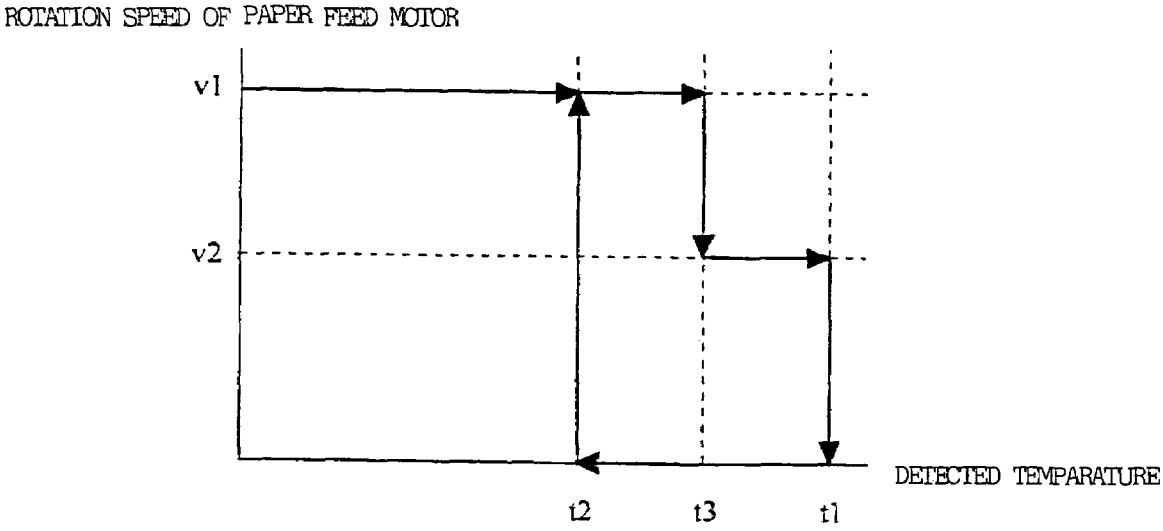
FIG. 7 is a graph showing a relationship between the detected temperature and the rotation speed of a paper feed motor based on a second thermal printer control method according to the present invention.

A relationship between the detected temperature and the drive of the thermal head 3*b* and the drive speed of the paper feed motor based on the second control method is explained by using FIG. 7.

When the temperature detecting device 8 detects that the temperature of one of the thermal head 3*b* and the paper feed motor 5 reaches a third set temperature t3 which is set beforehand so as to extend the time until the temperature of one of the thermal head 3*b* and the paper feed motor 5 reaches the allowable temperature, the control circuit (not shown) lowers the drive speed of thermal head 3*b* and the rotation speed of the paper feed motor 5 rotating at a rotation speed v1, so that the paper feed motor 5 is rotated at a rotation speed v2.

The drive speed of the thermal head 3*b* and the rotation speed of paper feed motor 5 are lowered, thereby making the temperature rise of the thermal head 3*b* and the paper feed motor 5 moderated. When the temperature detecting device 8 detects that the temperature of one of the thermal head 3*b* and the paper feed motor 5 reaches a first set temperature t1 which is set beforehand so as to prevent the temperature of one of the thermal head 3*b* and the paper feed motor 5 from exceeding the allowable temperature, the control circuit (not shown) stops the drive of the thermal head 3*b* and the paper feed motor 5 rotating at the rotation speed v2.

When the temperature of one of the thermal head 3*b* and the paper feed motor 5 is lowered by heat dissipation in the state where the thermal head 3*b* and the paper feed motor 5 are stopped, to reach the second set temperature t2, the control circuit starts the drive of the thermal head 3*b* and the paper feed motor 5. Incidentally, the allowable temperature value of the thermal head 3*b* adopted in the second control method is set to 65° C., the allowable temperature value of the paper feed motor 5 is set to 115° C. In relation to these values, the first set temperature t1 is set to 65° C., and the second set temperature t2 is set to 60° C., and the third set temperature t3 is set to 62.5° C.

Figure 8:
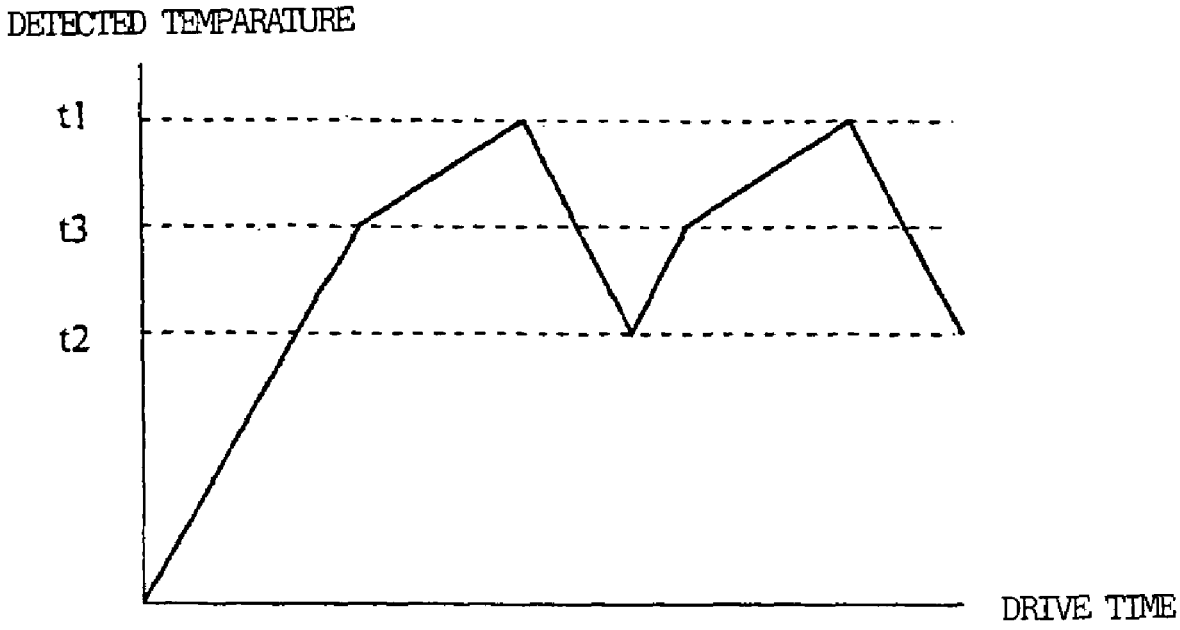
FIG. 8 is a graph showing a relationship between the thermal printer drive time and the detected temperature based on the second control method.

A relationship between the drive time and the detected temperature based on the second control method is explained by using FIG. 8.

As described above, when the temperature detected by the temperature detecting device 8 reaches the third set temperature t3, the control circuit (not shown) lowers the drive speed of the thermal head 3*b* and the rotation speed of paper feed motor 5. By lowering the drive speed of the thermal head 3*b* and the rotation speed of the paper feed motor 5, the temperature rise of the thermal head 3*b* and the paper feed motor 5 is moderated. When the temperature detecting device 8 detects that the temperature of one of the thermal head 3*b* and the paper feed motor 5 reaches the first set temperature t1 which is set beforehand so as to prevent the temperature of one of the thermal head 3*b* and the paper feed motor 5 from exceeding the allowable temperature, the control circuit stops the drive of thermal head 3*b* and the paper feed motor 5 rotating at the rotation speed v2.

As described above, when the temperature detected by the temperature detecting device 8 reaches the first set temperature t1, and the drive of the thermal head 3*b* and the paper feed motor 5 is stopped, then the temperature detected by the temperature detecting device 8 is lowered by the stopping of the drive of the thermal head 3*b* and the paper feed motor 5, to reach the second set temperature t2. Then, the control circuit (not shown) starts the drive of the thermal head 3*b* and the paper feed motor 5. When the temperature detected by the temperature detecting device 8 is raised by the starting of the drive of the thermal head 3*b* and the paper feed motor 5 to reach the first set temperature t1, the control circuit stops the drive of the thermal head 3*b* and the paper feed motor 5. Thereby, the temperature of the thermal head 3*b* and the paper feed motor 5 is lowered by heat dissipation.

In this way, when the temperature detected by the temperature detecting device 8 reaches the third set temperature t3, the drive speed of the thermal head 3*b* and the rotation speed of the paper feed motor 5 are lowered. This moderates the temperature rise of the thermal head 3*b* and the paper feed motor 5 to extend the time until the temperature of the thermal head 3*b* and the paper feed motor 5 reaches the allowable temperature. Thus, although the print processing speed is lowered, the frequency that the print processing is stopped is reduced. As a result, an operator is less liable to worry about the occurrence of failure in the printer and also relieved of an inconvenience due to nonoperation of the printer. Further, the temperature measured by the temperature detecting device 8 is prevented from exceeding the first set temperature t1. This makes it possible to suppress the temperature of the thermal head 3*b* or the paper feed motor 5 below the allowable temperature, and to thereby prevent the thermal head 3*b* or the paper feed motor 5 from being burnt out.

Figure 9:
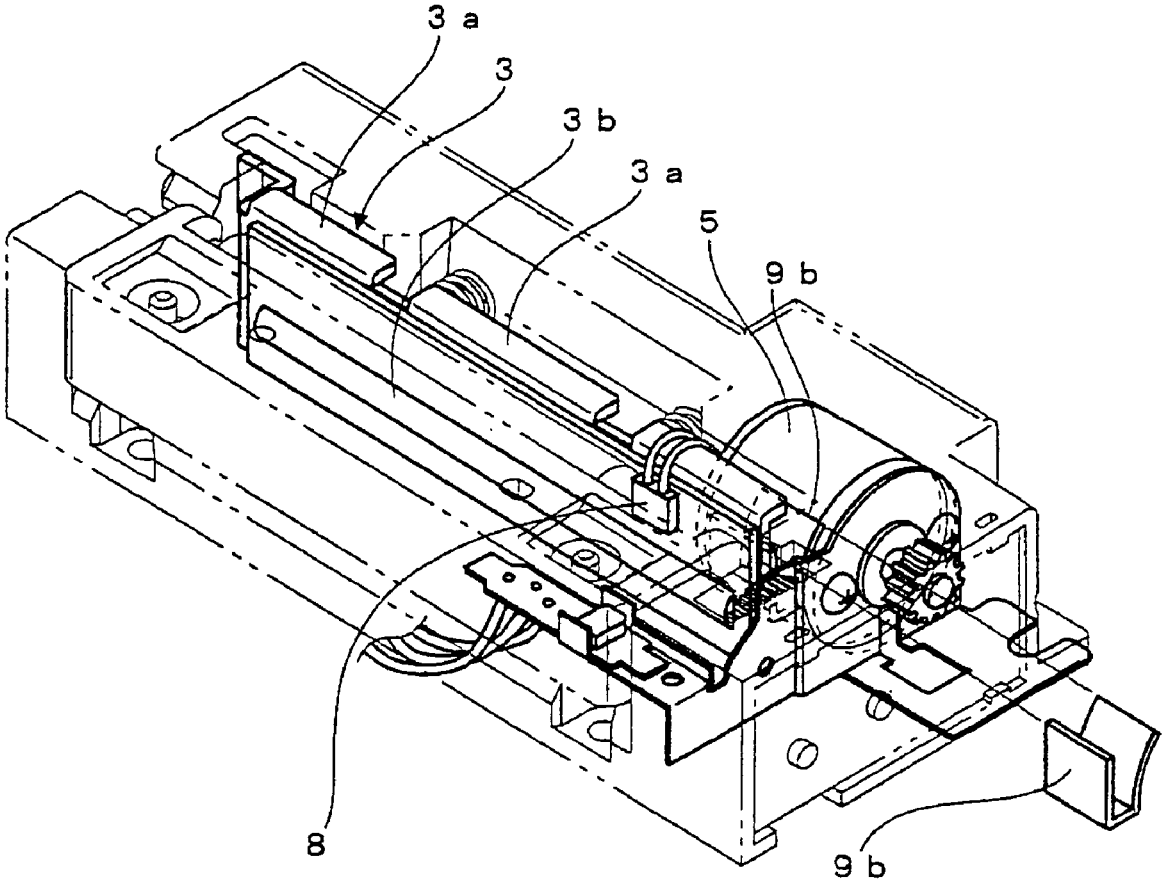
FIG. 9 is an illustration showing a state of a paper feed motor and a thermal head unit which are incorporated in a second embodiment of a thermal printer according to the present invention.
Figure 10:
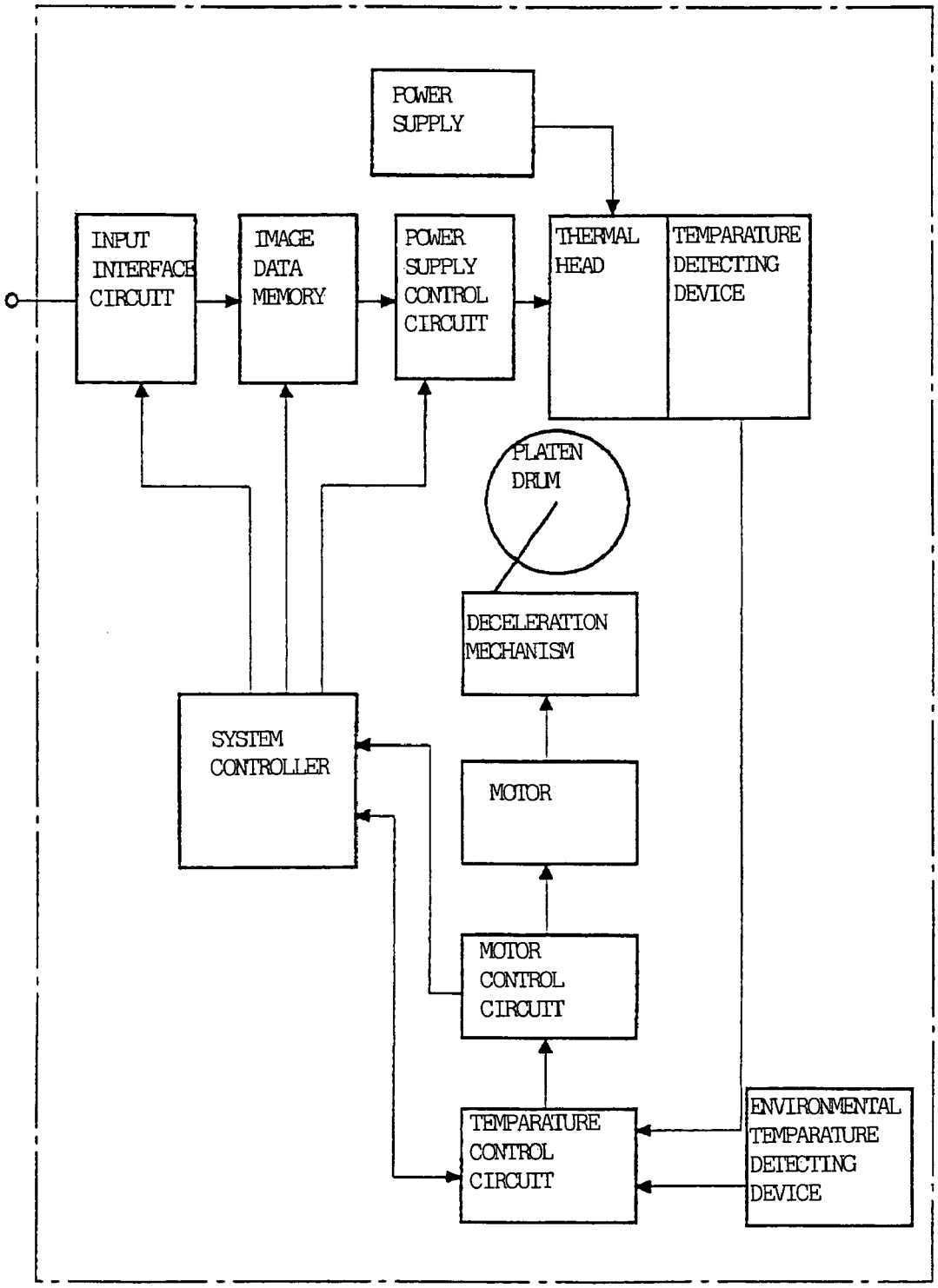
FIG. 10 is a block diagram showing the whole structure of a first prior art example of a printer (thermal printer)
Figure 11:
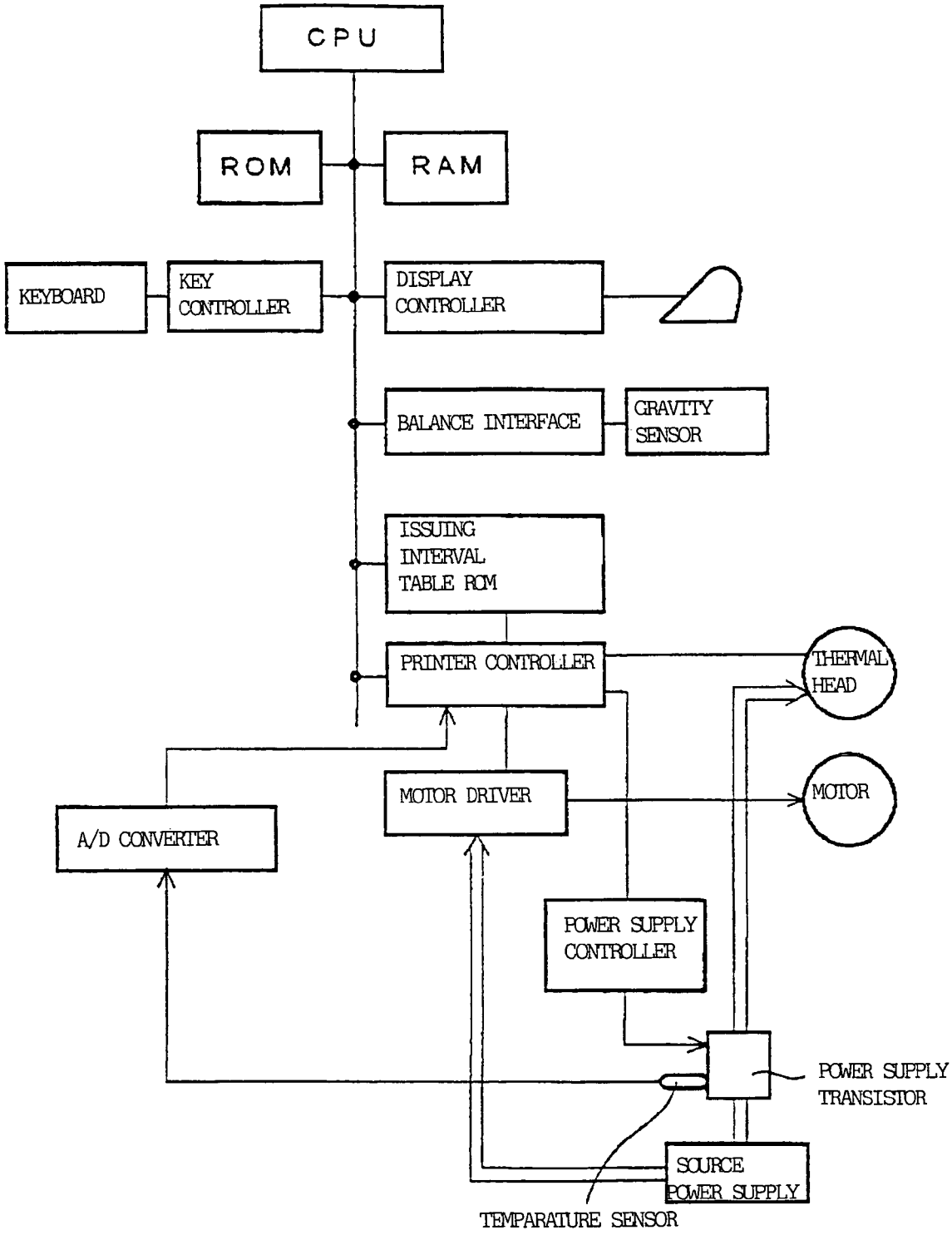
FIG. 11 is a block diagram showing a system structure of a second prior art example of a printer (label printer)
Figure 12:
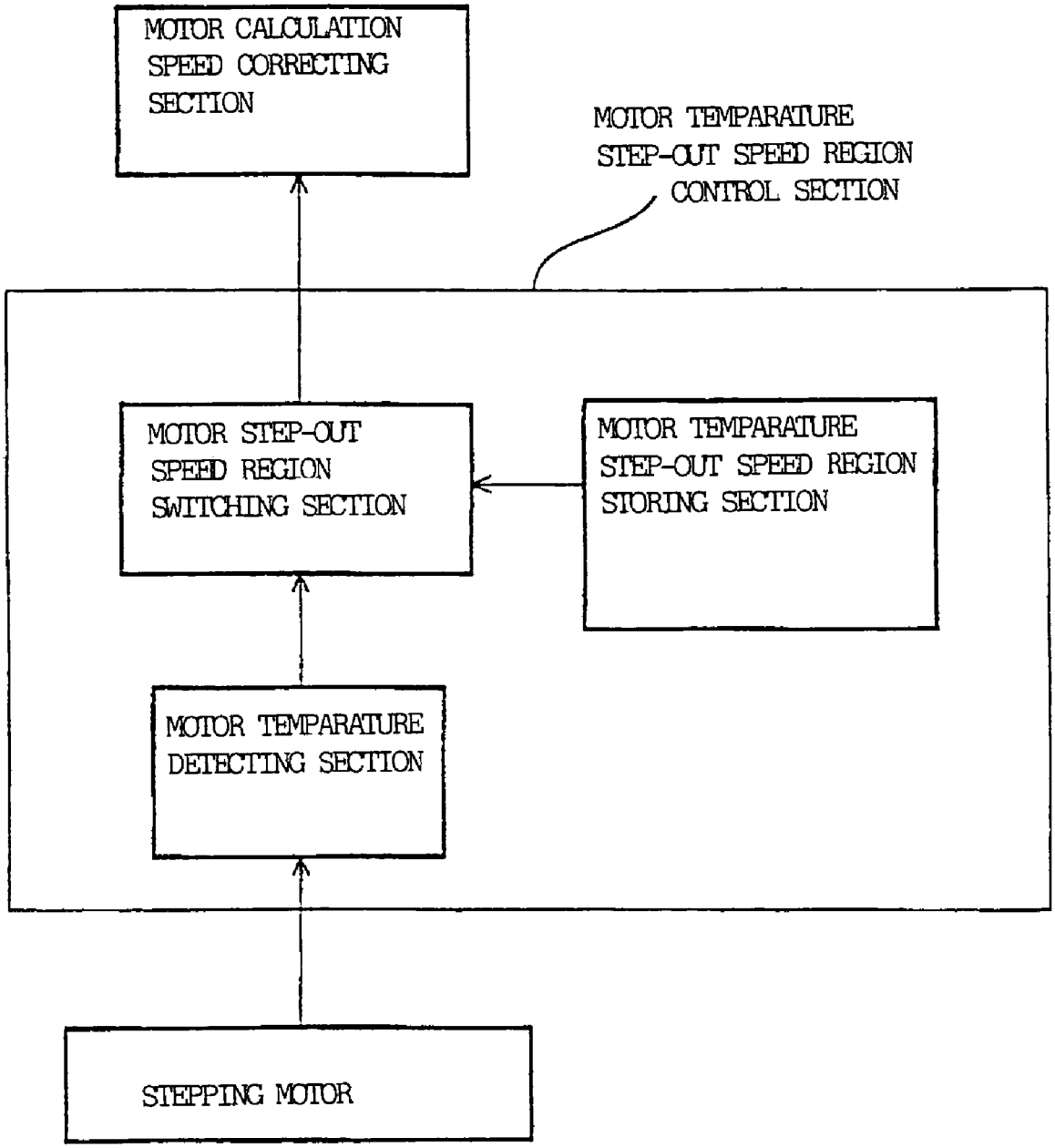
FIG. 12 is a block diagram showing a third prior art example of a printer (line thermal printer)
Figure 13:
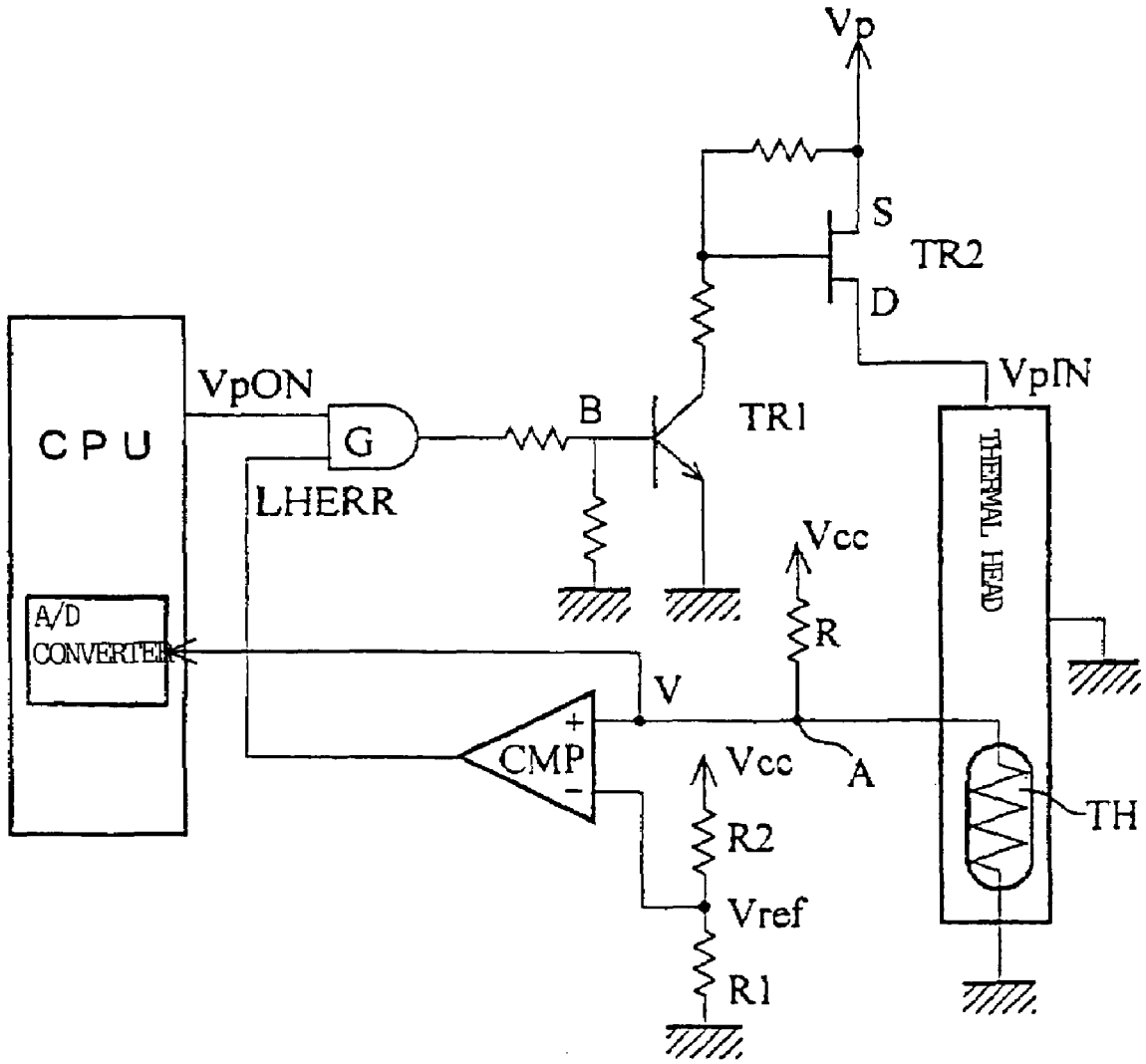
FIG. 13 is a partial circuit diagram of a fourth prior art example of a printer (thermal printer)
Figure 14:
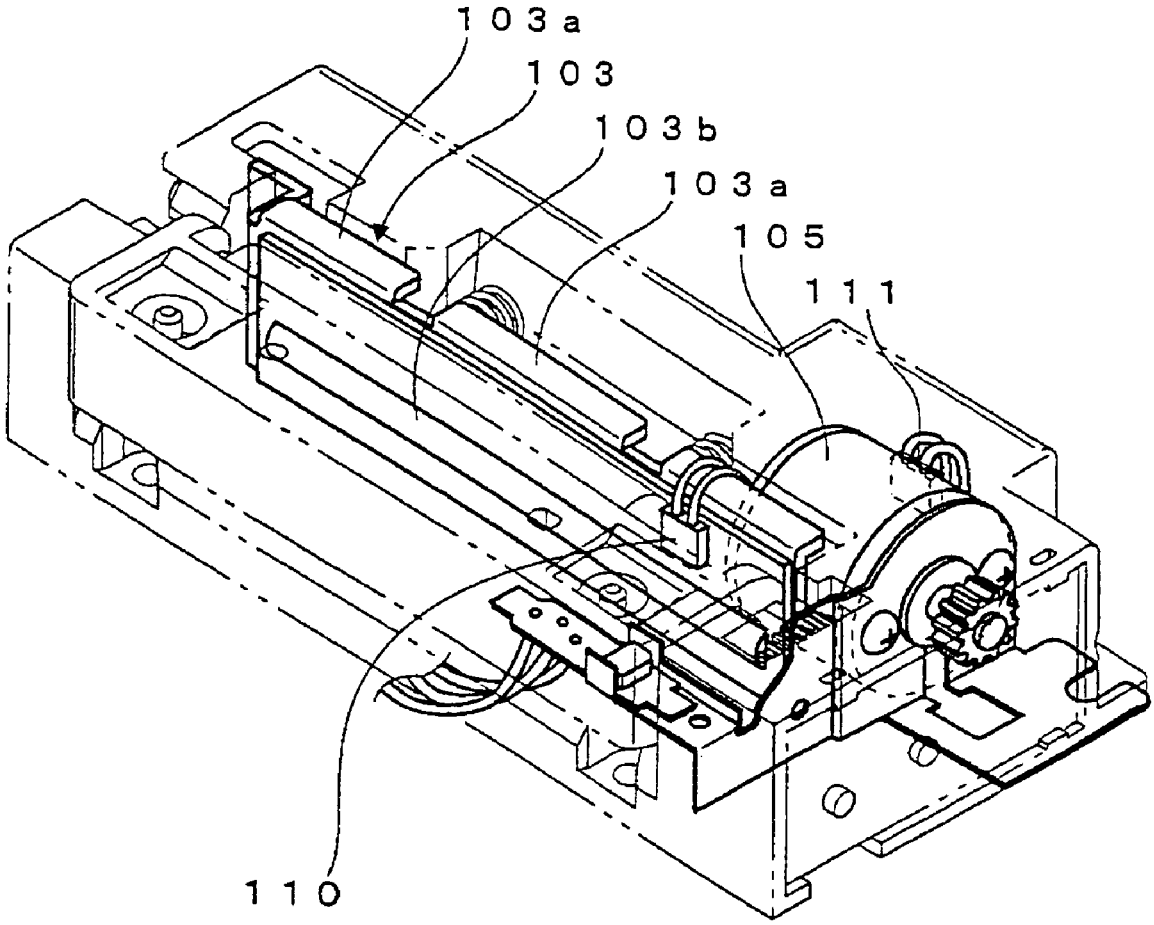
FIG. 14 is an illustration showing a state of a paper feed motor and a thermal head unit in a fifth prior art example of a printer (thermal printer).

A structure of the temperature control device in a second embodiment of the thermal printer according to the present invention is explained by using FIG. 9.

A second heat conducting member 9*b* formed by folding and bending a plate having high thermal conductivity and elasticity is secured between the paper feed motor 5 and the heat-dissipating member 3*a* of the thermal head unit 3. The heat generated by the paper feed motor 5 is arranged to be conducted to the thermal head unit 3 through the second heat conducting member 9*b*. The second heat conducting member 9*b* needs to have elasticity because of the same reason as that for the above described first heat conducting member 9*a*. Incidentally, the second heat conducting member 9*b* adopted in the present embodiment is formed by folding and bending a plate having high heat conductance and preferably made of an aluminum alloy or a copper alloy.

Further, the thermal head unit 3 is provided with the temperature detecting device 8 for detecting the temperature of the thermal head unit 3, which temperature is raised by the heat generated by the thermal head 3*b* and the heat generated by the paper feed motor 5, and for transmitting the detected temperature to the control circuit (not shown).

As described above, the present invention relates to a thermal printer which is provided with a thermal head printing on a paper sheet and a paper feed motor feeding the paper sheet, and which controls operation of the thermal head and the paper feed motor on the basis of detected temperature data of the thermal head and the paper feed motor detected by a single temperature detecting device. Therefore, it is possible to reduce the number of components and the number of assembling steps, to thereby reduce the manufacturing cost. Further, in addition to the heat generated by the thermal head 3*b*, the heat generated by the paper feed motor 5 is also dissipated by the heat-dissipating member 3*a*. Therefore, according to the present invention, the temperature rise of the paper feed motor 5 can be suppressed, as a result of which it is possible to extend the continuous operation time of the paper feed motor 5 in high temperature environment in comparison with a structure with no connection to the heat-dissipating member 3*a*.

The invention claimed is:

1. A thermal printer comprising:

a thermal head unit including a thermal head for printing on a paper sheet;

a paper feed motor for feeding the paper sheet;

a heat conducting member provided between the thermal head unit and the paper feed motor; and a single temperature detecting device for detecting temperature of the thermal head unit and the paper feed motor.

2. A thermal printer comprising:

a thermal head unit including a thermal head for printing on a paper sheet;

a paper feed motor for feeding the paper sheet;

a heat conducting member provided between the thermal head unit and the paper feed motor;

a single temperature detecting device for detecting temperature of the thermal head unit and the paper feed motor; and a control section for controlling operation of the thermal head unit and the paper feed motor, wherein the control section controls operation of the thermal head unit and the paper feed motor on the basis of detected temperature data of the thermal head unit and the paper feed motor detected by the single temperature detecting device.

3. The thermal printer according to claim 2, wherein a first set temperature for suppressing the respective temperatures of the thermal head and the paper feed motor to an allowable temperature or lower and a second set temperature for restarting the drive of the thermal head and the paper feed motor are set to prevent the thermal head and the paper feed motor from being burnt out.

4. The thermal printer according to claim 3, wherein a third set temperature is set between said first set temperature and said second set temperature, and wherein when the detected temperature data is raised and judged to reach the third set temperature, rotation speed of the paper feed motor is reduced to a speed lower than the rotation speed before the judgment is made.

5. The thermal printer according to claim 1 or claim 2, wherein the thermal head unit further comprises a heat-dissipating member in addition to the thermal head.

6. The thermal printer according to claim 1 or claim 2, wherein the temperature detecting device is provided in the thermal head unit.

7. The thermal printer according to claim 1 or claim 2, wherein the heat conducting member is deformed in response to a change of a distance between the thermal head and the paper feed motor, and thereby always brought into contact with the paper feed motor to effect heat conduction to the thermal head.

8. The thermal printer according to claim 7, wherein a material of the heat conducting member is silicone rubber.

9. The thermal printer according to claim 7, wherein a material of the heat conducting member is a plate of an aluminum alloy.

10. The thermal printer according to claim 7, wherein a material of the heat conducting member is a plate of a copper alloy.

11. A control method for a thermal printer, wherein the thermal printer comprises a thermal head for printing on a paper sheet, a paper feed motor for feeding the paper sheet, a single temperature detecting device for detecting temperature of the thermal head and the paper feed motor, and a control section for controlling operation of the thermal head and the paper feed motor, and wherein the control section controls operation of the thermal head and the paper feed motor on the basis of detected temperature data of the thermal head and the paper feed motor detected by the single temperature detecting device, and wherein the control section performs control in a manner that when it is judged that the detected temperature data reaches a first set temperature, the control section stops driving the thermal head unit and the paper feed motor to stop printing operation, and that when it is judged that the detected temperature data reaches a second set temperature lower than the first set temperature, the control section drives the thermal head unit and the paper feed motor to restart the printing operation.

12. A control method for a thermal printer, wherein the thermal printer comprises a thermal head unit including a thermal head for printing on a paper sheet, a paper feed motor for feeding the paper sheet, a single temperature detecting device for detecting temperature of the paper feed motor and the thermal head unit, and a control section for controlling operation of the thermal head and the paper feed motor, and wherein the control section controls operation of the thermal head unit and the paper feed motor on the basis of detected temperature data detected by the single temperature detecting device, and wherein the control section performs control in a manner that when it is judged that the detected temperature data reaches a first set temperature, the control section stops driving the thermal head unit and the paper feed motor to stop printing operation, and that when it is judged that the detected temperature data reaches a second set temperature lower than the first set temperature, the control section drives the thermal head unit and the paper feed motor to restart the Printing operation.

13. The control method for the thermal printer according to claim 11 or claim 12, wherein a third set temperature is set between said first set temperature and said second set temperature, and wherein the control section performs control in a manner that when it is judged that the detected temperature data is raised to reach the third set temperature, the control section reduces rotation speed of the paper feed motor to a speed lower than a speed before the judgment is made.

* * * * *